US008650674B2

(12) United States Patent
Ton

(10) Patent No.: US 8,650,674 B2
(45) Date of Patent: Feb. 18, 2014

(54) ADJUSTABLE FOOTREST MOUNTING SYSTEM

(76) Inventor: Quy That Ton, Baton Rouge, LA (US)

( * ) Notice: Subject to any disclaimer, the term of this patent is extended or adjusted under 35 U.S.C. 154(b) by 767 days.

(21) Appl. No.: 12/502,610

(22) Filed: Jul. 14, 2009

(65) Prior Publication Data

US 2011/0010837 A1 Jan. 20, 2011

(51) Int. Cl.
*A47K 3/022* (2006.01)

(52) U.S. Cl.
USPC ..... 4/622; 297/423.46

(58) Field of Classification Search
USPC ..... 4/621, 622, 574.1; 297/423.26, 423.46
See application file for complete search history.

(56) References Cited

U.S. PATENT DOCUMENTS

| | | | | |
|---|---|---|---|---|
| 1,985,807 | A | 12/1934 | Steigerwald et al. | |
| 2,528,331 | A | 10/1950 | Bell | |
| 2,566,498 | A | 9/1951 | Revercomb | |
| 2,850,081 | A | 9/1958 | Dillon | |
| 4,549,767 | A | 10/1985 | Hampshire et al. | |
| 5,419,618 | A | 5/1995 | Hatcher | |
| 6,503,212 | B2 * | 1/2003 | Park | 601/158 |
| 7,052,082 | B1 | 5/2006 | Thomas | |
| 7,717,514 | B2 * | 5/2010 | Redmann | 297/313 |
| 2007/0226896 | A1 * | 10/2007 | Fugate et al. | 4/622 |
| 2009/0058164 | A1 | 3/2009 | Ton | |

* cited by examiner

*Primary Examiner* — Tuan N Nguyen
(74) *Attorney, Agent, or Firm* — Minh N. Nguyen, Esq.; Next IP Law Group LLP

(57) ABSTRACT

A footrest mounting system is disclosed. In one embodiment, the footrest mounting system comprises: a mounting platform that is coupled to a footrest; a mounting arm that is coupled to the mounting platform at a proximal end; and a lower body having at least one mounting depression in which the mounting arm is disposed within such that the footrest is positioned at an incline relative to the lower body.

9 Claims, 5 Drawing Sheets

ADJUSTABLE FOOTREST MOUNTING SYSTEM

BACKGROUND

In a salon environment, a pedicure spa may be employed with a footrest and/or foot pedal. Such a footrest or foot pedal may be employed for comfort of a client in a salon environment when receiving a pedicure. The footrest may allow a client in a salon environment to rest at least one foot adjacent to or near a basin employed in the pedicure process.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION

Figure 1:
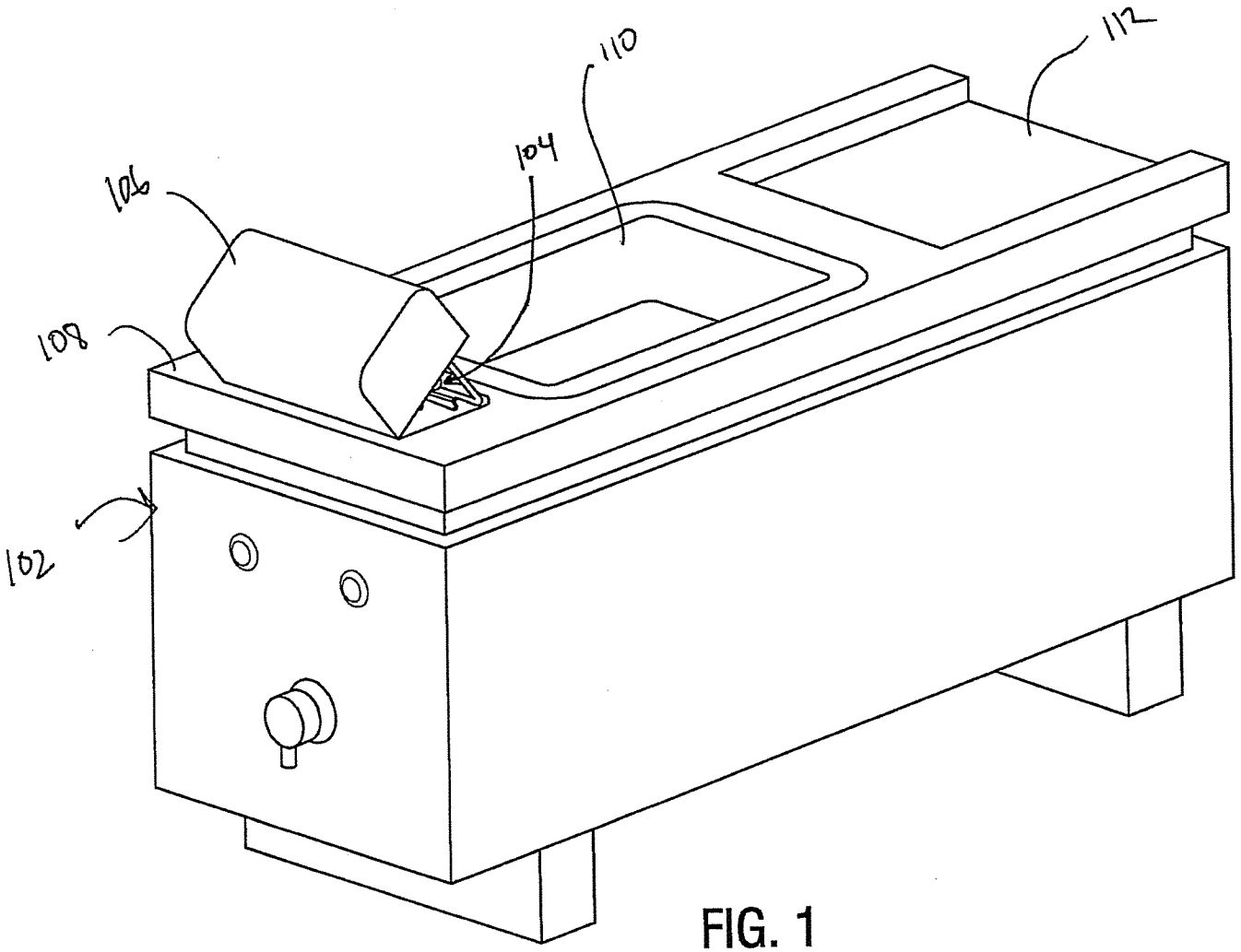
FIG. 1 is a perspective view of an adjustable footrest mounting system in a pedicure spa according to one embodiment of the disclosure.

With reference to FIG. 1, shown is one example of a pedicure spa 102 incorporating an adjustable footrest mounting system 104. The adjustable footrest mounting system 104 can be configured to facilitate adjustment of one or more footrest 106 or other surface of a pedicure spa. Additionally, an embodiment of the adjustable footrest mounting system 104 can further allow adjustment of a footrest 106 or other surface by a salon professional while performing a pedicure and/or other tasks. In one embodiment, the footrest 106 is positioned on a surface 108 of the pedicure spa 102 near or adjacent to a basin 110 that is employed in the pedicure process. It should be appreciated that the depicted shape of the footrest 106 is merely exemplary, and that one or more footrests, pedals, or other structures can be employed in accordance with the disclosure.

A chair or seating surface can optionally be positioned adjacent to and/or overlapping a seating surface 112 of the spa 102. The basin 110 is generally positioned between the seating surface 112 and footrest 106, allowing water and/or other fluids or materials to be filled therein and a pedicure client's feet submersed. Accordingly, a client receiving a pedicure may place one or both feet in the basin 110 and/or on the footrest 106 when receiving a pedicure.

The adjustable footrest mounting system 104 can allow various levels of adjustability of the footrest 106. In other words, the adjustable footrest mounting system 104 can allow a footrest 106 to be positioned at various inclines or angles. Alternatively, the adjustable footrest mounting system 104 can facilitate substantially flat positioning of the footrest 106 relative to the surface 108 of the spa 102. Additionally, the footrest 106 can be adjustable by a salon professional administering a pedicure with one hand, allowing a salon professional to perform other tasks with a free hand while adjusting the footrest 106 via the adjustable footrest mounting system 104.

Figure 2:
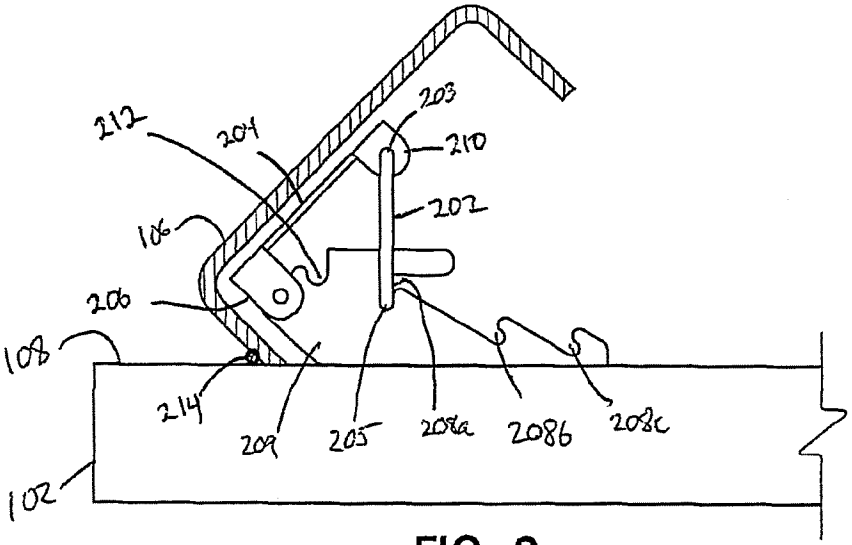
FIG. 2 is a cross-sectional view of an adjustable footrest mounting system according to one embodiment of the disclosure.

Reference is now made to FIG. 2, which depicts a cross sectional view of the adjustable footrest mounting system 104 according to one embodiment of the disclosure. The adjustable footrest mounting system 104 is coupled to the footrest 106 in order to provide the above noted adjustability. The system 104 further includes a mounting arm 202 and mounting platform 204. The footrest 106 is mounted on or near the mounting platform 204 to secure the footrest 106 to the adjustable footrest mounting system 104. The footrest 106 can be mounted to the mounting platform 204 in a variety of ways. As one non-limiting example, the footrest 106 can be bolted, welded, or secured via an adhesive to the mounting platform 204. The footrest 106 can also be configured to substantially enclose or cover the adjustable footrest mounting system 104 when in operation.

The mounting arm 202 is coupled to the mounting platform 204 at a proximal end 203. The mounting arm 202 can include a metal and/or metal alloy arm extending from an arm coupler 210 and configured to restrict movement of the mounting platform 204 when the arm 202 is secured within one or more mounting depressions. The mounting platform 204 may also include an arm coupler 210 that is configured to couple the mounting arm 202 to the mounting platform 204 while allowing the mounting arm 202 to rotate about the arm coupler 210. In one non-limiting embodiment, the arm coupler 210 can comprise one or more holes through which the mounting arm 202 can extend and rotate within. Additionally, the mounting platform 204 may also include rotating hinge 206 configured to allow the mounting platform 204 to rotate relative to the lower body 209 of the system 104.

The mounting arm 202 is further configured to provide various levels of adjustability of the footrest 106 in conjunction with mounting depressions 208 positioned along the system 104. As depicted in FIG. 2, a distal end 205 of the mounting arm 202 is disposed within a first mounting depression 208*a* that is configured to allow the footrest 106 to be positioned in an inclined position relative to the surface 108 of the pedicure spa 102. The mounting arm distal end 205 and mounting depression 208*a* further substantially secure the inclined position of the footrest 106 such that movement of the footrest 106 is restricted. In this non-limiting configuration, the rotating hinge 206 allows the mounting platform 204 to rotate to an incline relative to the surface 108 of the pedicure spa 102.

Figure 3:
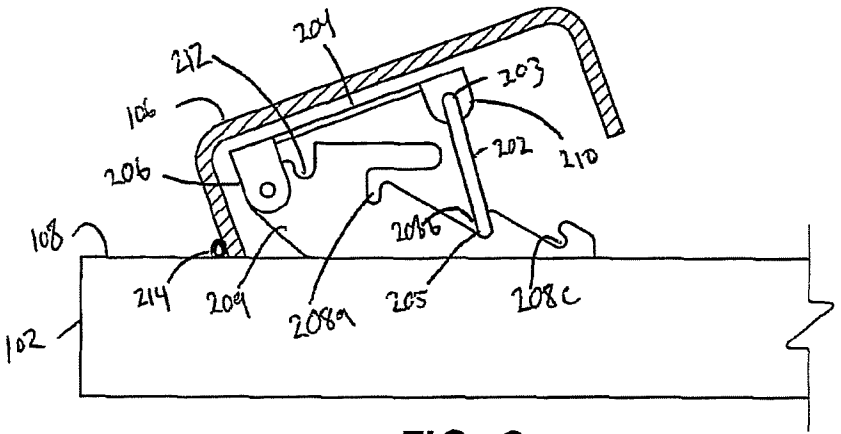
FIG. 3 is a cross-sectional view of an adjustable footrest mounting system according to one embodiment of the disclosure.

Reference is now made to FIG. 3, which depicts a cross sectional view of the adjustable footrest mounting system 104 according to one embodiment of the disclosure. FIG. 3 further depicts an alternative configuration of the adjustable footrest mounting system 100 according to one embodiment of the disclosure. In the depicted configuration, the mounting arm distal end 205 is disposed within the mounting depression 208*b* of the lower body 209 of the mounting system 100 such that the footrest 106 is positioned at an incline relative to the surface 108 of the pedicure spa 102. Because the mounting arm coupler 210 allows the mounting arm to rotate about the mounting platform 204 and the rotating hinge 206 allows the mounting platform 204 to rotate about the fixed lower body 209 of the adjustable footrest mounting system 104, the depicted configuration allows a varying level of incline to be chosen according to the desires of a salon professional performing a pedicure and/or client receiving a pedicure.

Figure 4:
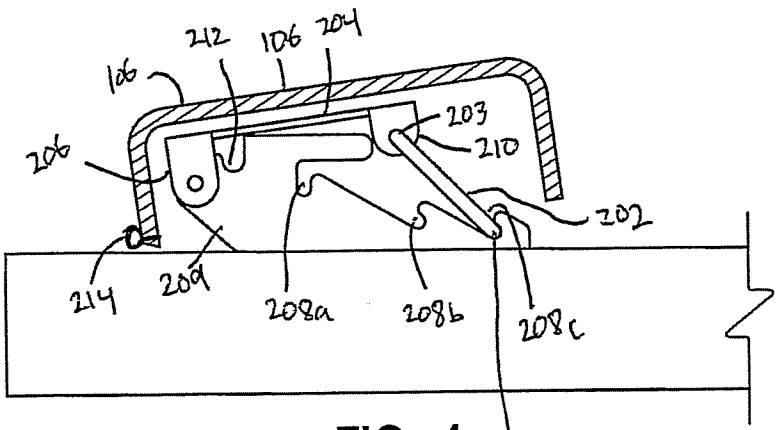
FIG. 4 is a cross-sectional view of an adjustable footrest mounting system according to one embodiment of the disclosure.

Reference is now made to FIG. 4, which depicts a cross sectional view of the adjustable footrest mounting system 104 according to one embodiment of the disclosure. FIG. 4 further depicts an alternative configuration of the adjustable footrest mounting system 100 according to one embodiment of the disclosure. In the depicted configuration, the mounting arm distal end 205 is disposed within the mounting depression 208*b* of the lower body 209 of the mounting system 100 such that the footrest 106 is positioned at yet another incline relative to the surface 108 of the pedicure spa 102. Because the mounting arm coupler 210 allows the mounting arm to rotate about the mounting platform 204 and the rotating hinge 206 allows the mounting platform 204 to rotate about the fixed lower body 209 of the adjustable footrest mounting system 104, the depicted configuration allows yet another varying level of incline to be chosen according to the desires of a salon professional performing a pedicure and/or client receiving a pedicure.

Figure 5:
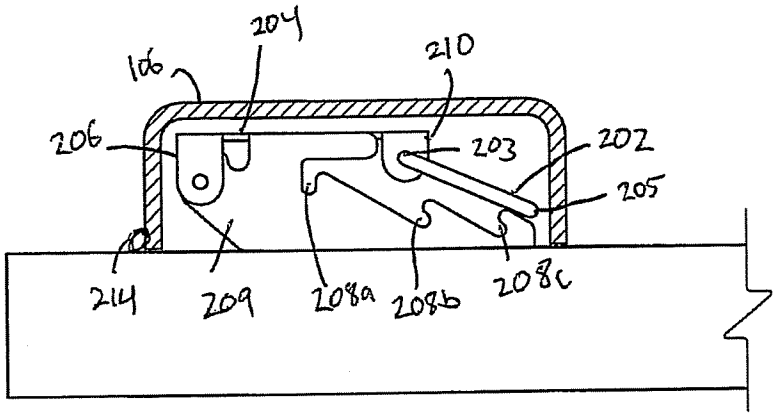
FIG. 5 is a cross-sectional view of an adjustable footrest mounting system according to one embodiment of the disclosure.

Reference is now made to FIG. 5, which depicts a cross sectional view of the adjustable footrest mounting system 104 according to one embodiment of the disclosure. FIG. 5 further depicts an alternative configuration of the adjustable footrest mounting system 100 according to one embodiment of the disclosure. In the depicted configuration, the mounting arm distal end 205 is not disposed within the mounting depressions 208 of the lower body 209 of the mounting system 100. Accordingly, the footrest 106 is positioned substantially parallel relative to the surface 108 of the pedicure spa 102. As an alternative configuration, the mounting arm distal end 205 can be disposed within upper mounting depression 212, which can result in the mounting platform 204 and footrest 106 being positioned in a substantially parallel configuration relative to the surface 108 of the pedicure spa 102.

Figure 6:
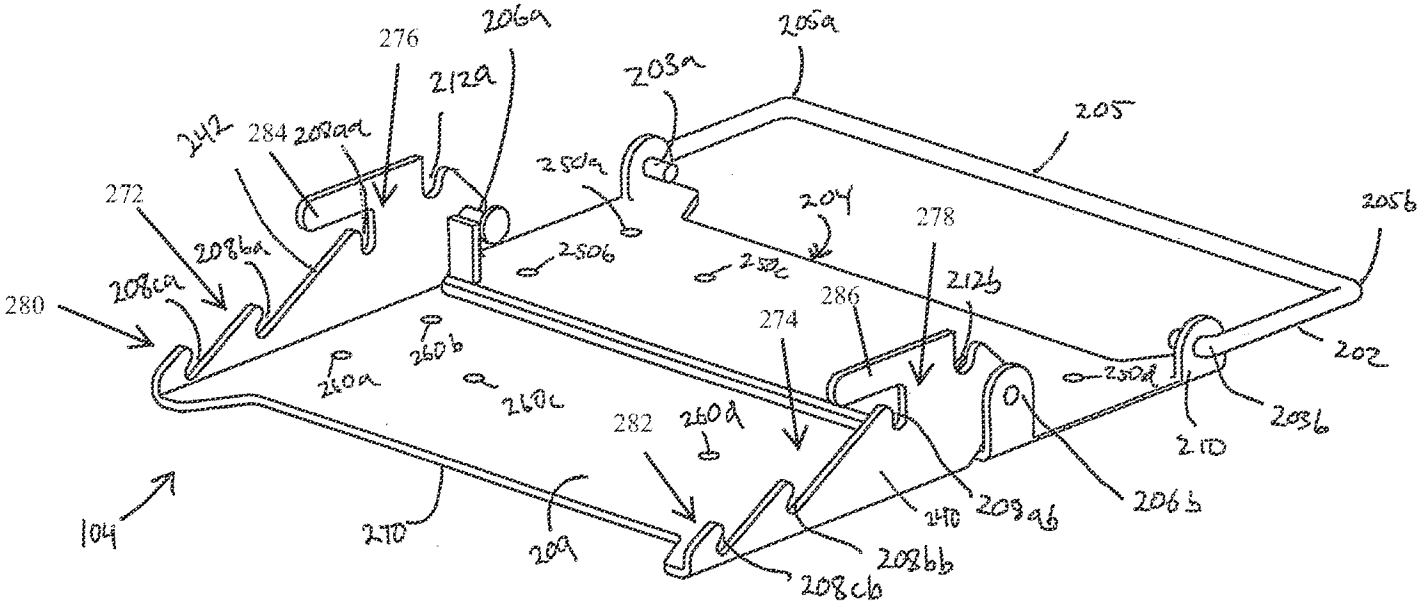
FIG. 6 is a perspective view of an adjustable footrest mounting system according to one embodiment of the disclosure.

Reference is now made to FIG. 6, which depicts a perspective view of the adjustable footrest mounting system 104. FIG. 6 further depicts the mounting platform 204 with footrest mounting holes 250. Additionally, FIG. 6 depicts sidewalk 240, 242 of the lower body 209 of the system 104. The exemplary sidewalls 240, 242 can include triangular bodies coupled to a lower mounting surface 270 of the system 104. Further, the sidewalls 240, 242 include the above noted mounting depressions 208 configured to receive the mounting arm distal end 205. In the depicted configuration mounting depression 208*aa* is configured to receive mounting arm distal end 205*a*, and mounting depression 208*ab* is configured to receive mounting arm distal end 205*b*. Each side wall 240, 242 has a horizontal bottom edge connecting to the lower mounting surface 270 and a tapered top edge 272, 274 having a first height 276, 278 and tapered to a second height 280, 282 that is lower than the first height 276, 278. Each side wall 240, 242 includes a horizontal locking bar 284, 286 that is formed at a highest mounting depression 208*aa*, 208*ab* and extends horizontally over the highest mounting depression 208*aa*, 208*ab* towards lowest mounting depression 208*ca*, 208*cb* to prevent the mounting arm 205 from moving beyond the highest mounting depression 208*aa*, 208*ab* so as to lock the footrest 106 at the highest incline position relative to the lower body 209.

The footrest mounting holes 250 are configured to secure a footrest 106 (FIG. 1) to the adjustable footrest mounting system 104. A footrest 106 can be mounted to the system 104 by driving bolts, screws, or the like through the footrest mounting holes 250. Alternatively, a footrest can be mounted in other various ways. As a non-limiting example, a footrest can be mounted to the mounting platform 204 via an adhesive, snap-fitting system, clamping system, or other connection system as can be appreciated. FIG. 6 further depicts a lower mounting surface 270 of the lower body 209 of the system 104. The lower mounting surface 270 includes bracket mounting holes 260 that are configured to mount the adjustable footrest mounting system 104 to a surface 108 (FIG. 1) of a pedicure spa 102 (FIG. 1).

Figure 7:
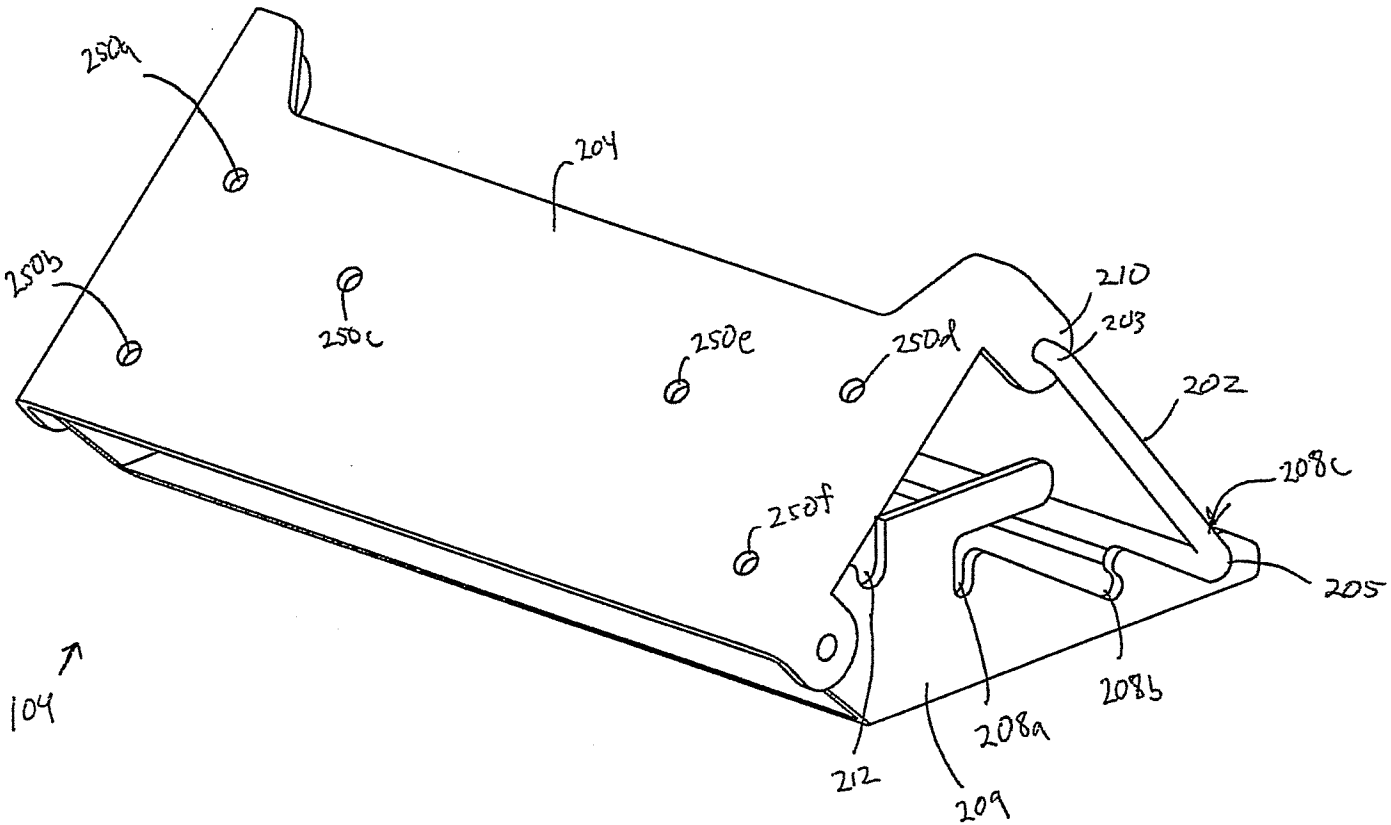
FIG. 7 is a perspective view of an adjustable footrest mounting system according to one embodiment of the disclosure.

Accordingly, the adjustable footrest mounting system 104 can be mounted to the surface 108 of the pedicure spa 102 by driving bolts, screws, or the like through the bracket mounting holes 260 and into corresponding holes on or adjacent to the surface 108 of the pedicure spa 102. Alternatively, the system 104 can be mounted to the surface 108 of the pedicure spa 102 in other various ways. As a non-limiting example, the lower body 109 of the system 104 can be mounted to the surface 108 via an adhesive, snap-fitting system, clamping system, or other connection system as can be appreciated. Reference is now made to FIG. 7, which depicts a perspective view of the adjustable footrest mounting system 104. FIG. 7 depicts the mounting platform 204 of the system 104 as well as mounting holes 250.

It should be emphasized that the above-described embodiments of the present invention are merely possible examples of implementations, merely set forth for a clear understanding of the principles of the invention. Many variations and modifications may be made to the above-described embodiment(s) of the invention without departing substantially from the spirit and principles of the invention. As one example, the various components of the disclosed system can be positioned in various ways and in various configurations consistent with the scope of the disclosure. All such modifications and variations are intended to be included herein within the scope of this disclosure and the present invention.

Therefore, having thus described the disclosure, at least the following is claimed:

1. A footrest mounting system comprising:

a mounting platform that is coupled to a footrest;

a mounting arm that is coupled to the mounting platform at a proximal end; and a lower body having a lower mounting surface and opposing side walls, each side wall has a horizontal bottom edge connecting to the lower mounting surface and a tapered top edge having a first height and tapered to a second height that is lower than the first height, wherein the side walls include at least one mounting depression in which the mounting arm is disposed within such that the footrest is positioned at an incline relative to the lower body, wherein the at least one mounting depression includes a highest mounting depression formed at the first height of the side walls and a lowest mounting depression formed at the second height of the side walls, wherein each side wall includes a horizontal locking bar that is formed at the highest mounting depression and extends horizontally over the highest mounting depression towards the lowest mounting depression to prevent the mounting arm from moving beyond the highest mounting depression so as to lock the footrest at the highest incline position relative to the lower body.

2. The footrest mounting system as defined in claim 1, further comprising an arm coupler that is configured to couple the mounting arm to the mounting platform while allowing the mounting arm to rotate about the arm coupler.

3. The footrest mounting system as defined in claim 2, wherein the arm coupler includes one or more holes through which the mounting arm can extend and rotate within.

4. The footrest mounting system as defined in claim 1, further comprising a rotating hinge configured to allow the mounting platform to rotate relative to the lower body.

5. The footrest mounting system as defined in claim 1, wherein the side walls includes upper mounting depressions in which the mounting arm can reside therein that can result in the mounting platform and footrest being positioned in a substantially parallel configuration relative to the lower body.

6. A pedicure spa comprising:

a basin;

a base in which the basin and chair being attached to a top portion of the base; and a footrest mounting system including:

a mounting platform that is coupled to a footrest, a mounting arm that is coupled to the mounting platform at a proximal end, and a lower body having a lower mounting surface and opposing side walls, each side wall has a horizontal bottom edge connecting to the lower mounting surface and a tapered top edge having a first height and tapered to a second height that is lower than the first height, wherein the side walls include at least one mounting depression in which the mounting arm is disposed within such that the footrest is positioned at an incline relative to the lower body, wherein the at least one mounting depression includes a highest mounting depression formed at the first height of the side walls and a lowest mounting depression formed at the second height of the side walls, wherein each side wall includes a horizontal locking bar that is formed at the highest mounting depression and extends horizontally over the highest mounting depression towards the lowest mounting depression to prevent the mounting arm from moving beyond the highest mounting depression so as to lock the footrest at the highest incline position relative to the lower body.

7. The pedicure spa as defined in claim 6, further comprising an arm coupler that is configured to couple the mounting arm to the mounting platform while allowing the mounting arm to rotate about the arm coupler.

8. The pedicure spa as defined in claim 7, wherein the arm coupler includes one or more holes through which the mounting arm can extend and rotate within.

9. The pedicure spa as defined in claim 6, further comprising a rotating hinge configured to allow the mounting platform to rotate relative to the lower body.

* * * * *